US005749717A

United States Patent [19]

Straub et al.

[11] Patent Number: 5,749,717

[45] Date of Patent: May 12, 1998

[54] ELECTROMAGNETIC FUEL PUMP FOR A COMMON RAIL FUEL INJECTION SYSTEM

[75] Inventors: Robert D. Straub, Lowell; Richard Frederic Teerman, Wyoming; Thomas M. Stegink, Kalamazoo; Daniel B. Ogren, Hudsonville, all of Mich.

[73] Assignee: Deisel Technology Company, Wyoming, Mich.

[21] Appl. No.: 527,364

[22] Filed: Sep. 12, 1995

[51] Int. Cl.[6] ..... F02M 37/04

[52] U.S. Cl. ..... 417/505; 123/506

[58] Field of Search ..... 417/505; 123/506

[56] References Cited

U.S. PATENT DOCUMENTS

| | | | |
|---|---|---|---|
| 3,779,225 | 12/1973 | Watson et al. | 123/506 |
| 4,618,095 | 10/1986 | Spoolstra . | |
| 4,619,239 | 10/1986 | Wallenfang et al. | 123/506 |
| 4,782,807 | 11/1988 | Takahashi | 123/506 |
| 4,829,967 | 5/1989 | Nuti | 123/506 |
| 5,373,828 | 12/1994 | Askew | 123/506 |

*Primary Examiner*—Richard E. Gluck
*Attorney, Agent, or Firm*—Brooks & Kushman P.C.

[57] ABSTRACT

A pump for a fuel injection system, the pump primarily including a pump body having a pumping chamber and a pump body end portion, a control valve disposed in a control valve chamber, a reciprocatable plunger, and a cylindrical sleeve having first and second end portions. The first end portion of the sleeve interfits with the pump body end portion. The second end portion of the sleeve slidably interfits with a cam follower assembly for allowing the cam follower assembly to drive the plunger. The plunger is reciprocated with respect to the sleeve over a stroke range between an extended position and a retracted position. A plunger spring biases the plunger to the retracted position. The pump body end portion is press-fit into the first end portion of the sleeve, and sufficiently induces compressive forces in the pump body for acting on the pumping chamber to oppose pumping chamber expansive forces.

35 Claims, 3 Drawing Sheets

ELECTROMAGNETIC FUEL PUMP FOR A COMMON RAIL FUEL INJECTION SYSTEM

TECHNICAL FIELD

This invention relates to pumps, more particularly, to a unit pump for heavy duty truck diesel fuel injection systems.

BACKGROUND ART

Fuel injection pumps are used in fuel systems for internal combustion engines. Performance, fuel efficiency, and emissions are a few of the things that are greatly influenced by the combustion process, and the fuel injection process.

One way of improving combustion is to increase injection pressure. Another way of improving combustion is to obtain more sophisticated and precise control of the process.

For the foregoing reasons, there is a need for a fuel injection pump that overcomes the problems and limitations of the prior art.

DISCLOSURE OF THE INVENTION

It is, therefore, an object of the present invention to provide an improved pump for a fuel injection system.

It is another object of the present invention to provide an improved pump for operating with increased injection pressure.

It is a further object of the present invention to provide an improved pump for more precisely controlling the injection process.

In carrying out the above objects and other objects and features of the present invention, a pump is provided having a fuel inlet for supplying fuel to a pumping chamber, an outlet port discharging to a high pressure line and spray nozzle, and a control valve chamber between the pumping chamber and the outlet port. A reciprocating plunger having a head end and a tail end is disposed in the pumping chamber. The plunger reciprocates over a stroke range between an extended position and a retracted position. A plunger spring resiliently biases the plunger to the retracted position, and a control valve controls the fuel. The pump further comprises a cam follower assembly including a housing receiving the tail end of the plunger therein, and a cylindrical sleeve having first and second end portions. The first end portion of the cylindrical sleeve interfits with an end portion of the pump body. The second end portion of the cylindrical sleeve slidably interfits with the cam follower assembly. This allows the cam follower assembly to drive the plunger thereby reciprocating the plunger with respect to the cylindrical sleeve over the stroke range.

In a preferred construction, the interfitting of the first end portion of the cylindrical sleeve with the pump body end portion is a press-fit, and suffciently induces compressive forces in the pump body for acting on the pumping chamber to oppose pumping chamber expansive forces. Thus, the portion of the pump body most susceptible to radial expansion, namely, the pumping chamber at the extended position of the stroke range, is provided with internal compressive stresses about the pumping chamber as a result of the press-fit, thereby substantially increasing the efficiency of the pump by reducing leakage past the plunger.

Further, a retainer guide extends through an aperture in the cylindrical sleeve and engages an elongated slot in the housing of the cam follower assembly. The retainer guide allows the cam follower assembly to relatively reciprocate within the cylindrical sleeve while the retainer guide is engaging the slot. Its primary purpose is to assure ongoing alignment of the cam follower with the driving cam.

Further, in a preferred construction, a plunger spring seat is received in the housing of the cam follower assembly. First and second ends of the plunger spring abut the plunger spring seat and the pump body end portion. The plunger spring seat has an entry hole in communication with a pivot hole, the pivot hole defines the seat pivot surface. The tail end of the plunger is receivable through the entry hole for engagement with the pivot hole, and the tail end of the plunger has a plunger pivot surface pivotally engaging the seat pivot surface when the tail end of the plunger is engaged with the pivot hole. This assumes axial alignment of the plunger throughout its stroke, despite the possibility of the coil spring ends being out-of-square with its axis.

Preferably, the seat pivot surface and the plunger pivot surface are matching spherical surfaces. Thus, the plunger pivot surface has a radius of curvature equal to that of the seat pivot surface. Alternatively, the seat pivot surface could be a conical surface generated by a plane curve.

Further, in the preferred construction, the pump body has a first annulus in communication with the fuel inlet for supplying fuel to the fuel inlet, and a second annulus in fluid communication with the pumping chamber and the control valve chamber for receiving excess fuel from these chambers. An annular belt separates the first and second annuli. The annular belt has an uninterrupted outer surface and may be in slight clearance relation with the cylinder block bore as there is no O-ring provided between the first and second annulus. The fuel leakage between the two fuel paths is allowed in favor of eliminating a counterbore in the block, thereby allowing either (i) a pump body of increased radial dimension or (ii) a shorter cylinder block, depending on the design choice.

In accordance with the invention, a fuel fill tube extends from the pump body. The fuel fill tube is adapted to be received by a socket located in an engine block for angularly aligning the pump with respect to the engine block, and thereby aligning the cam follower axis with the camshaft axis.

In a preferred construction, the pump is electronically controlled and further comprises an electromagnetic actuator disposed in a stator assembly. An armature is secured to the control valve, the control valve is an electromagnetically actuated control valve and includes a piston valve body axially movable between an unactuated position and an actuated position within the control valve chamber. An elastically deformable stop plate secures a valve stop within the pump body. A control valve spring resiliently biases the piston valve body into the unactuated position. A stator spacer is disposed between the pump body and the stator assembly and has a central opening that receives the armature. A plurality of fasteners mount the stator assembly on the pump body, each fastener extends through the stator assembly, the stator spacer, and the pump body. Upon actuation of the control valve, the piston valve body is urged to the actuated position against the biasing of the control valve spring.

Preferably, the valve stop extends outboard of the pump body and the stop plate is elastically deformed when securing in the valve stop. The valve stop is said to be "proud" of the pump body. The elastically deformed stop plate induces forces on the valve stop for assuring that it is permanently anchored to the pump body at the designed valve clearance from the valve seat.

The above objects and other objects, features, and advantages of the present invention will be readily appreciated by one of ordinary skill in the art from the following detailed description of the best mode for carrying out the invention when taken in connection with the accompanying drawings.

BEST MODES FOR CARRYING OUT THE INVENTION

Figure 1:
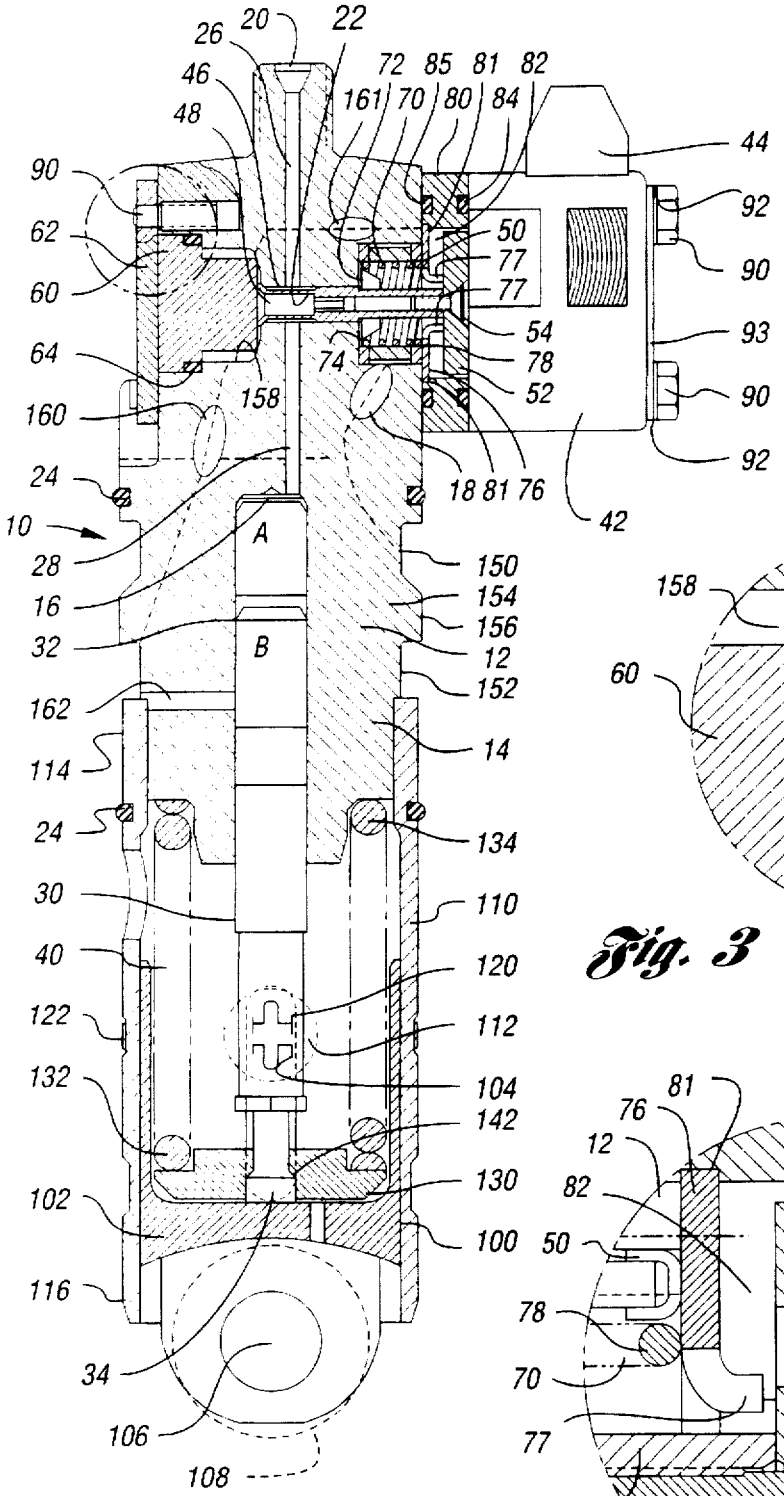
FIG. 1 is a side elevation, in section, of a pump for a fuel injection system made in accordance with the present invention.
Figure 2:
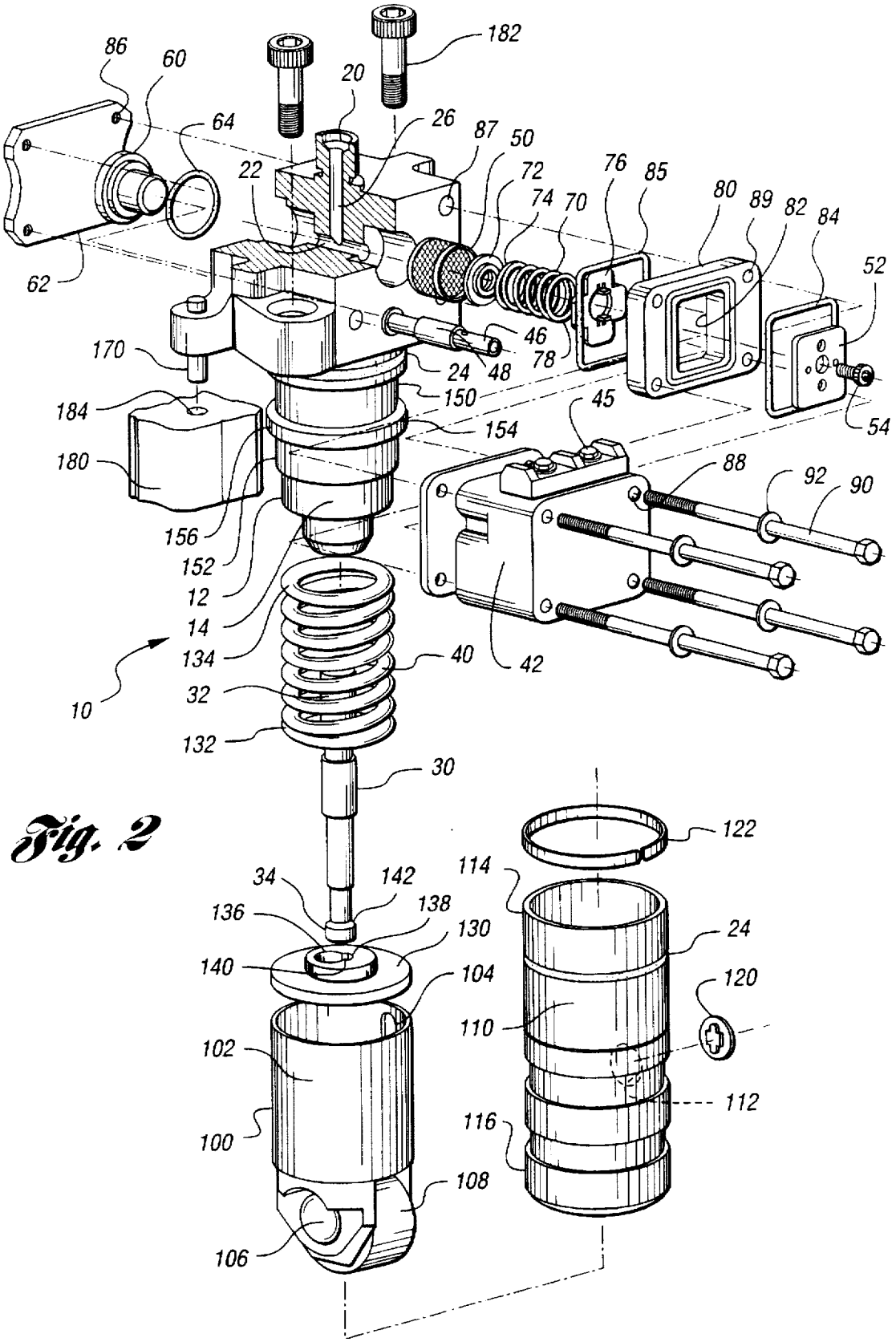
FIG. 2 is an exploded perspective view of the pump of FIG. 1 further illustrating the fuel fill tube and a portion of an engine block.

Referring now to FIGS. 1 and 2, a pump 10 made in accordance with the present invention is illustrated. It will be recognized that many design features of the pump 10 are equally applicable to a unit fuel injector, as shown, for example, in U.S. Pat. No. 4,618,095, assigned to the assignee of the present invention, and incorporated herein by reference. By referring herein to a pump, Applicants include a unit fuel injector. The pump 10 has a pump body 12 with a pump body end portion 14. A pumping chamber 16 is defined by pump body 12. A fuel inlet 18 for supplying fuel to pumping chamber 16 is located on the periphery of pump body 12. Pump body 12 further has an outlet port 20, and a control valve chamber 22 between pumping chamber 16 and outlet port 20. O-rings 24 are provided to seal fuel inlet 18 with respect to an engine block which receives pump 10. Passageways 26 and 28 connect outlet port 20, control valve chamber 22, and pumping chamber 16, respectively.

With reference to FIG. 1, a reciprocating plunger 30 is disposed in pumping chamber 16. Plunger 30 has a head end 32 and a tail end 34. Plunger 30 is reciprocatable over a stroke range between an extended position indicated at A in dotted line and a retracted position indicated at B. A plunger spring 40 resiliently biases plunger 30 to the retracted position B.

With continuing reference to FIGS. 1 and 2, a stator assembly 42 contains an electromagnetic actuator 44, such as a solenoid, and has terminals 45 for connecting to a power source to provide power for electromagnetic actuator 44. An electromagnetically actuated control valve 46 is disposed in control valve chamber 22 for controlling fuel. Control valve 46 includes a piston valve body 48. Piston valve body 48 is movable between an unactuated position and an actuated position within control valve chamber 22. An annular fuel filter 50 is disposed in pump body 12 about a central axis of piston valve body 48. Fuel inlet 18 allows fuel to pass through fuel filter 50 prior to entering pumping chamber 16. An armature 52 is secured to control valve 46 by a fastener such as a screw 54.

Figure 6:
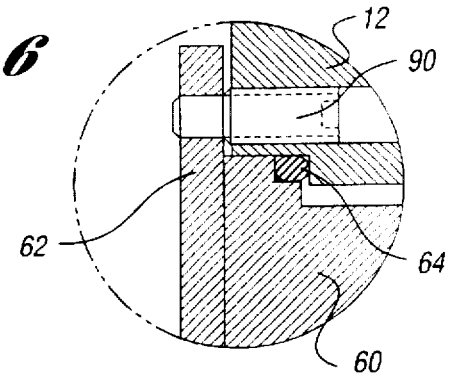
FIG. 6 is an enlarged cross-sectional view of the stop plate on the pump shown in FIG. 1.

A valve stop 60 is disposed in pump body 12 adjacent to control valve chamber 22. As shown in detail in FIG. 6, valve stop 60 extends outboard of pump body 12, and is said to be "proud" of pump body 12. An elastically deformable stop plate 62 secures valve stop 60 within pump body 12, and induces forces on valve stop 60 for assuring the valve stop is always seated on the valve body. This feature also assists in dampening undesired control valve vibrations or control valve "bounce" caused by control valve 46 contacting valve stop 60. An O-ring 64 encircles valve stop 60.

A control valve spring 70 resiliently biases piston valve body 48 into the unactuated position. A control valve spring seat 72 and a control valve spring retainer 76 having flanges 77 abut first and second ends 74 and 78 of control valve spring 70, respectively.

A stator spacer 80 having a central opening 82 for receiving armature 52 therein is disposed between pump body 12 and stator assembly 42. Stator spacer 80 has notches 81 for receiving retainer 76. O-rings 84 and 85 seal stator spacer 80 against stator assembly 42 and pump body 12, respectively.

Stop plate 62 has holes 86 in alignment with holes 87 in pump body 12, and holes 88 and 89 in stator assembly 42 and stator spacer 80, respectively. Fasteners 90 extend through stator assembly 42, stator spacer 80, and pump body 12. Fasteners 90 secure stop plate 62 against valve stop 60, elastically deforming stop plate 62, and induces forces on valve stop 60. The through bolts 90 extending from the coil side of the valve body to anchor stop plate 62 may also assist elastic deformation when selected and sized to permit elastic deformation along their respective lengths. Preferably, washers 92 are used with fasteners 90, and a nameplate 93 may be secured to stator assembly 42 for identification purposes.

With further reference to FIGS. 1 and 2, a cam follower assembly 100 is illustrated. Cam follower assembly 100 has a housing 102 with an elongated slot 104. Cam follower assembly 100 has an axle 106 and a roller 108 for engagement with a camshaft (not shown). Plunger 30 is reciprocated within pumping chamber 16 between the extended position A and the retracted position B by cam follower assembly 100. A cylindrical sleeve 110 has an aperture 112 in communication with elongated slot 104. Cylindrical sleeve 110 has first and second end portions 114 and 116, respectively. Pump body end portion 14 interfits with first end portion 114 of cylindrical sleeve 110.

In the preferred construction, pump body end portion 14 is press-fit into first end portion 114 of cylindrical sleeve 110. This press-fit substantially eliminates radial expansion of pumping chamber 16 under the high fuel pressures developed, i.e., approximately 28,000 psi.

The press-fit of pump body end portion 14 into first end portion 114 of cylindrical sleeve 110 sufficiently induces compressive forces in pump body 12 for acting on pumping chamber 16 to oppose pumping chamber expansive forces. The portion of pump body 12 most susceptible to expansion is pumping chamber 16 at the extended position A of the stroke range. This portion of pump body 12 is not enclosed by cylindrical sleeve 110, however, internal compressive stresses are present about pumping chamber 16 as a result of the press-fit to oppose radial expansion thereof. Additionally, pumping chamber 16 and the pump body plunger bore are nitrided.

Second end portion 116 of cylindrical sleeve 110 relatively reciprocatably interfits with cam follower assembly 100 for allowing cam follower assembly 100 to drive plunger 30. Cam follower assembly 100 reciprocates within cylindrical sleeve 110 and drives plunger 30 relative to cylindrical sleeve 110 over the stroke range.

Preferably, a retainer guide 120 extends through aperture 112, cylindrical sleeve 110, and engages slots 104 in cam follower assembly 100. A clip 122 retains guide 120 within aperture 112.

A plunger spring seat 130 is received in housing 102 of cam follower assembly 100. Plunger spring seat 130 abuts a first end 132 of plunger spring 40. Pump body end portion 14 abuts second end 134 of plunger spring 40. Plunger spring seat 130 has an entry hole 136 in communication with a pivot hole 138. Pivot hole 138 defines a seat pivot surface 140. Tail end 34 of plunger 30 is received through entry hole 136 for engagement with pivot hole 138. Tail end 34 of plunger 30 has a plunger pivot surface 142. Seat pivot surface 140 pivotally engages plunger pivot surface 142.

With further reference to FIGS. 1 and 2, pump body 12 has a first annulus 150 in communication with fuel inlet 18 for supplying fuel to the pumping chamber 16. Pump body 12 further has a second annulus 152 in communication with pumping chamber 16 for receiving excess fuel therefrom. An annular belt 154 separates first and second annuli 150 and 152, respectively. Annular belt 154 has an uninterrupted outer surface 156. By omitting the use of an O-ring on annular belt 154, a boring operation on the engine block is eliminated. Each consecutive portion of the bore hole can then be slightly larger in diameter, and the previously smallest diameter portion of the bore hole can be made slightly larger. The portion of the bore receiving cylindrical sleeve 110 is therefore slightly larger in diameter than previously. Among other things, this allows for use of a slightly thicker and stronger cylindrical sleeve 110 without having to increase the size of the cylinder block.

An excess fuel chamber 158 receives excess fuel from control valve chamber 22. A conventional fuel equalizing passage 161 provides fuel communication between excess fuel chamber 158 and the control valve and spring chambers. A return passageway 160 connects excess fuel chamber 158 to second annulus 152. Another return passageway 162 connects pumping chamber 16 to second annulus 152 for receiving any fuel that leaks between plunger 30 and pump body 12. Second annulus 152 is defined by annular belt 154 and first end portion 114 of cylindrical sleeve 110.

Figure 8:
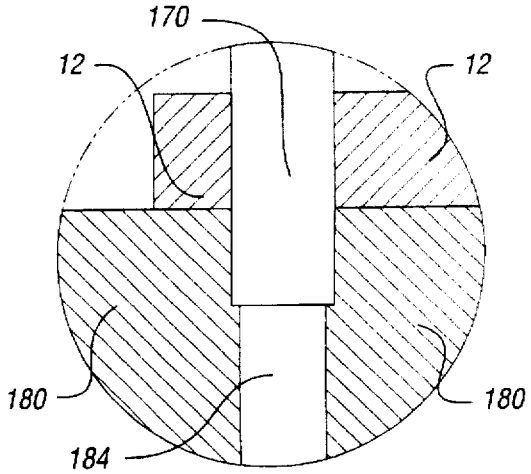
FIG. 8 is an enlarged cross-sectional view of the fuel fill tube in engagement with an engine block in accordance with the present invention.

As shown in FIGS. 2 and 8, a fuel fill tube 170 extends from pump body 12. Fuel fill tube 170 aligns pump body 12 to engine block 180, and provides a fuel connection to fuel inlet 18 through first annulus 150. As well known in the art, fuel fill tube 170 supplies fuel to pump 10 via an internal fuel passageway in the engine block suitably provided for this purpose. When pump 10 is received in the engine block 180, fuel fill tube 170 is received by a socket 184 located in engine block 180. Bolts 182 secure pump 10 to engine block 180. Because of necessary manufacturing tolerances in the pump 10 and the engine block 180, the bolts 182 have a small amount of slack. The fuel fill tube 170 is used to angularly align pump 10 with respect to engine block 180, and more importantly, align cam follower assembly 100 with the camshaft (not shown).

Figure 3:
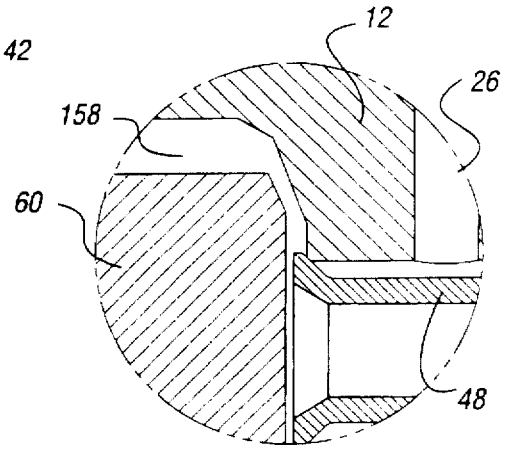
FIG. 3 is an enlarged cross-sectional view of the control valve on the pump shown in FIG. 1.

With reference now to FIG. 3, piston valve body 48 is shown in the unactuated position. Upon actuation, piston valve body 48 is urged outwardly against valve stop 60 and any tendencies toward control valve vibrations or "bounce" are dampened by the forces induced by elastically deformed stop plate 62. Fuel is allowed to flow through passageway 26 in pump body 12 toward outlet port 20 in accordance with control valve 46 being opened and closed in a fixed sequence allowing the desired fuel pressure to be developed while closed. Passageway 26 is always open to the pumping chamber but fuel flow to the nozzle is precluded, as described, and optionally with the assist of a pressure relief valve (not shown) within the high pressure line, pursuant to conventional practice.

Figure 4:
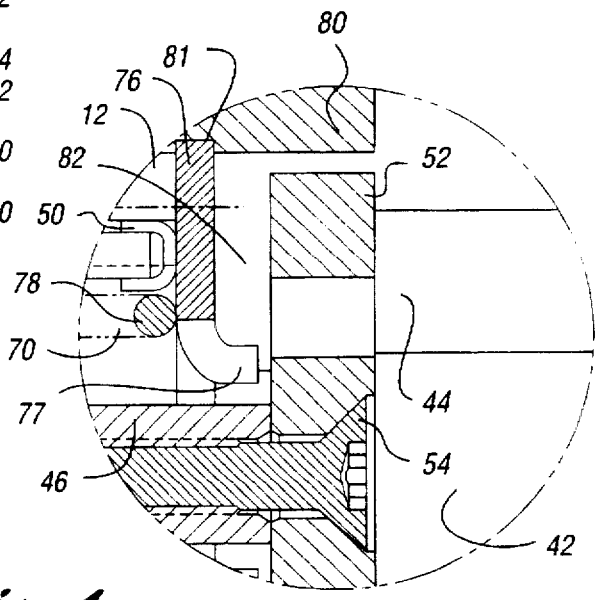
FIG. 4 is an enlarged cross-sectional view of the armature environment on the pump shown in FIG. 1.

With reference to FIGS. 2 and 4, armature 52 is secured to control valve 46 by screw 54. Spring retainer 76 has flanges 77 to facilitate assembly of the control valve spring environment. During assembly, fuel filter 50, control valve spring seat 72, control valve spring 70, and control valve 46 are received in pump body 12. Control valve spring retainer 76 is secured to stator spacer 80 by snap-fitting retainer 76 into notches 81 on stator spacer 80. Stator spacer 80 and retainer 76 are then placed about control valve 46, and armature 52 can then be fastened to control valve 46. Flanges 77 come in contact with armature 52, and maintain stator spacer 80 sufficiently close to pump body 12 so as to refrain O-ring 85 from sliding off stator spacer 80 and between stator spacer 80 and pump body 12. Stator assembly 42 can then be secured to pump body 12 without fear of O-ring 85 sliding off stator spacer 80.

Figure 5:
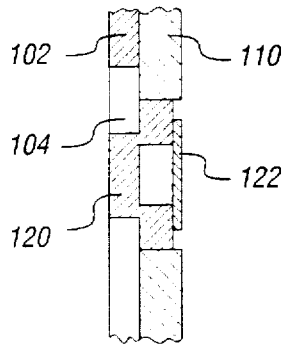
FIG. 5 is an enlarged cross-sectional view of the retainer guide on the pump shown in FIG. 1.

With reference to FIG. 5, retainer guide 120 extends through aperture 112 and engages slot 104 thereby allowing cam follower assembly 100 to relatively reciprocate within cylindrical sleeve 110 while retainer guide 120 is engaged with slot 104. Clip 122 encircles cylindrical sleeve 110, and retains guide 120 within aperture 112.

Figure 7:
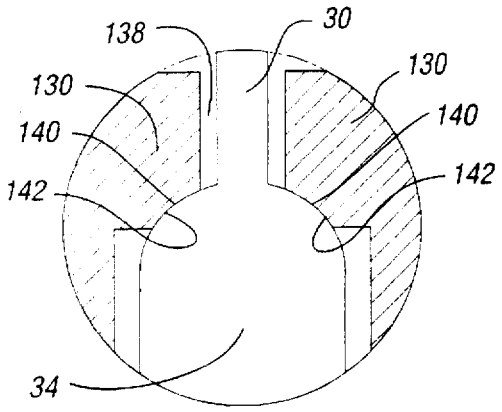
FIG. 7 is an enlarged cross-sectional view of the tail end of the plunger and the plunger spring seat on the pump shown in FIG. 1.

With reference to FIG. 7, tail end 34 of plunger 30 is engaged with pivot hole 138. Seat pivot surface 140 is shown in engagement with plunger pivot surface 142. Seat pivot surface 140 and plunger pivot surface 142 are matching spherical surfaces, i.e. having the same radius of curvature. Because of this relationship, plunger spring seat 130 can be askew of the axis of plunger 30 without adversely affecting reciprocation of plunger 30. In an alternate embodiment, the seat pivot surface 140 may be a conical surface generated by rotation of a line hence having a curvature of magnitude zero, and the plunger pivot surface 142 can be generated by rotation of a curve hence having a curvature of magnitude greater than zero.

Operation of pump 10 will now be described with reference to FIG. 1. Fuel is received from a fuel supply by first annulus 150 and supplied to fuel inlet 18. Fuel inlet 18 routes fuel through fuel filter 50 and to pumping chamber 16. The camshaft (not shown) drives cam follower assembly 100. Plunger 30 is moved from the retracted position B to the extended position A, and fuel is pressurized within pumping chamber 16.

Control valve 46 is controlled by electromagnetic actuator 44, and allows pressurized fuel to be directed through outlet port 20 by way of passageways 26 and 28. Control valve 46 operates in a conventional manner as shown and described for the control valve in U.S. Pat. No. 4,618,095 which has been incorporated herein by reference, and is assigned to the assignee of the present invention.

Figure 9:
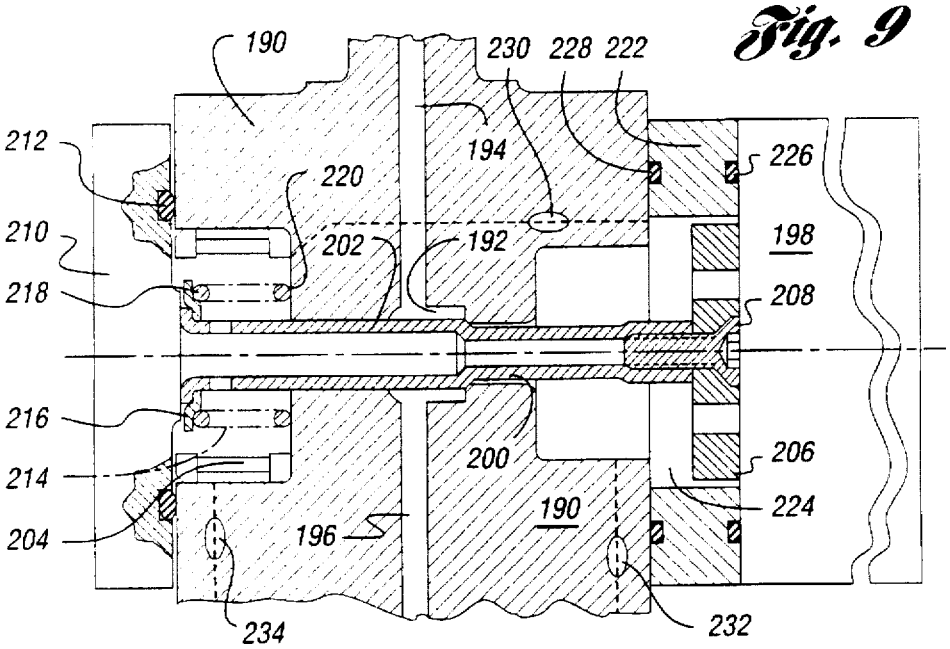
FIG. 9 is an alternative control valve arrangement in accordance with the present invention.

With reference now to FIG. 9, an alternative control valve arrangement is illustrated. A pump body 190 has a control valve chamber 192, an internal passageway 194 leading to an outlet port (not shown). Another internal passageway 196 leads to control valve chamber 192 from a pumping chamber (not shown). The control valve arrangement is provided with a fuel pressure equalizing passage 230, a fuel inlet 232, and a fuel outlet 234. A stator assembly 198 contains an electromagnetic actuator (not shown), such as a solenoid. An electromagnetically actuated control valve 200 is disposed in control valve chamber 192 for controlling fuel. Control valve 200 includes piston valve body 202. Piston valve body 202 is movable between an unactuated position and an actuated position within control valve chamber 192.

An annular fuel filter 204 is disposed in pump body 190 about a central axis of piston valve body 202. A fuel inlet (not shown) allows fuel to pass through fuel filter 204 prior to entering the pumping chamber (not shown). An armature 206 is secured to control valve 200 by a screw 208.

A valve stop plate 210 is disposed in pump body 190 adjacent to control valve chamber 192. Valve stop plate 210, when used in the configuration shown, eliminates the need for a separate valve stop and stop plate. An O-ring 212 encircles valve stop plate 210 and seals control valve chamber 192.

A control valve spring 214 resiliently biases piston valve body 202 into the unactuated position. A control valve spring seat 216 abuts a first end 218 of control valve spring 214. A second end 220 of control valve spring 214 abuts pump body 190.

A stator spacer 222 having a central opening 224 receiving armature 206 therein is disposed between pump body 190 and stator assembly 198. O-rings 226 and 228 seal stator spacer 222 against stator assembly 198 and pump body 190, respectively.

With continued reference to FIG. 9, piston valve body 202 is shown in the unactuated position. Upon actuation, piston valve body 202 is urged inwardly away from valve stop plate 210. Fuel is allowed to flow through passageway 196 in pump body 190 toward the outlet port (not shown) in accordance with control valve 200 as earlier described.

It is to be understood that while the forms of the invention described above constitute the preferred embodiments of the invention, the preceding description is not intended to illustrate all possible forms thereof. It is also to be understood that the words used herein are words of description, rather than limitation, and that various changes may be made without departing from the spirit and scope of the invention, which should be construed according to the following claims.

What is claimed is:

1. A pump for a fuel injection system, the pump comprising:

a pump body having a pump body end portion, a pumping chamber, a fuel inlet for supplying fuel to said pumping chamber, an outlet port, and a control valve chamber between said pumping chamber and said outlet port;

a reciprocating plunger disposed in said pumping chamber, said plunger having a head end and a tail end, said plunger being reciprocatable over a stroke range between an extended position and a retracted position;

a plunger spring for resiliently biasing said plunger to the retracted position;

a control valve disposed in said control valve chamber for controlling fuel;

a cam follower assembly including a housing receiving the tail end of said plunger therein; and cylindrical sleeve having first and second end portions, said pump body end portion being press-fit into the first end portion of the cylindrical sleeve, the second end portion of the cylindrical sleeve relatively reciprocatably interfitting with said cam follower assembly for allowing said cam follower assembly to drive said plunger thereby reciprocating said plunger with respect to said cylindrical sleeve over the stroke range.

2. The pump of claim 1 wherein the press-fit sufficiently induces compressive forces in said pump body for acting on said pumping chamber to oppose pumping chamber expansive forces.

3. The pump of claim 1 further comprising a retainer guide, wherein said cylindrical sleeve has an aperture, and wherein the housing of said cam follower assembly has an elongated slot in communication with the aperture, and the retainer guide extends through the aperture and engages the slot thereby allowing said cam follower assembly to relatively reciprocate within said cylindrical sleeve while said retainer guide is engaging the slot.

4. The pump of claim 1 further comprising a plunger spring seat received in the housing of said cam follower assembly wherein a first end of said plunger spring abuts said plunger spring seat and a second end of said plunger spring abuts said pump body end portion, said plunger spring seat having an entry hole in communication with a pivot hole, the pivot hole defining a seat pivot surface, the tail end of said plunger being receivable through the entry hole for engagement with the pivot hole, and the tail end of said plunger having a plunger pivot surface pivotally engaging the seat pivot surface when the tail end of said plunger is engaged with the pivot hole.

5. The pump of claim 4 wherein the seat pivot surface and the plunger pivot surface are spherical.

6. The pump of claim 5 wherein the seat pivot surface and plunger pivot surface are matching spherical surfaces of equal radii.

7. The pump of claim 1 wherein said pump body has a first annulus in communication with said fuel inlet for supplying fuel to said fuel inlet, a second annulus in communication with said pumping chamber and said control valve chamber for receiving excess fuel therefrom, and an annular belt separating said first and second annuli, said annular belt having an uninterrupted outer surface and an outer diameter no greater than that defining said first and second annulus.

8. The pump of claim 7 wherein said second annulus is defined by said annular belt and the first end portion of said cylindrical sleeve.

9. The pump of claim 1 further comprising a fuel fill tube extending from said pump body, said pump adapted to be received by an engine block and secured to the engine block by at least one bolt extending through said pump body and into the engine block, and said fuel fill tube adapted to be received by a socket located in the engine block for angularly aligning said pump with respect to the engine block.

10. A pump for a fuel injection system, the pump comprising:

a pump body having a pump body end portion, a pumping chamber, a fuel inlet for supplying fuel to said pumping chamber, an outlet port, and a control valve chamber between said pumping chamber and said outlet port;

a reciprocating plunger disposed in said pumping chamber, said plunger having a head end and a tail end, said plunger being reciprocatable over a stroke range between an extended position and a retracted position;

a plunger spring for resiliently biasing said plunger to the retracted position;

a control valve disposed in said control valve chamber for controlling fuel;

a cam follower assembly including a housing receiving the tail end of said plunger therein;

a cylindrical sleeve having first and second end portions, the first end portion interfitting with said pump body end portion, the second end portion relatively reciprocatably interfitting with said cam follower assembly for allowing said cam follower assembly to drive said plunger thereby reciprocating said plunger with respect to said cylindrical sleeve over the stroke range;

a stator assembly;

an electromagnetic actuator disposed in said stator assembly;

an armature secured to said control valve, said control valve being an electromagnetically actuated control valve and including a piston valve body axially movable between an unactuated position and an actuated position within said control valve chamber;

a valve stop disposed in said pump body adjacent said control valve chamber;

a stop plate securing said valve stop within said pump body;

a control valve spring for resiliently biasing said piston valve body into the unactuated position; and a stator spacer disposed between said pump body and said stator assembly and having a central opening for receiving said armature therein.

11. The pump of claim 10 wherein said stop plate is elastically deformable and said valve stop extends outboard of said pump body, the pump further comprising:

a plurality of fasteners mounting said stator assembly on said pump body, each fastener extending through said stator assembly, said stator spacer, and said pump body, for securing said stop plate against said valve stop, said stop plate being elastically deformed when securing said valve stop.

12. The pump of claim 10 wherein an annular fuel filter is disposed in said pump body about a central axis of said piston valve body.

13. The pump of claim 10 further comprising:

a control valve spring seat disposed in said pump body and abutting a first end of said control valve spring; and a control valve spring retainer disposed between said control valve spring and said armature, and abutting a second end of said control valve spring.

14. The pump of claim 10 wherein said pump body has a first annulus in communication with said fuel inlet for supplying fuel to said fuel inlet, a second annulus in communication with said pumping chamber and said control valve chamber for receiving excess fuel therefrom, and an annular belt separating said first and second annuli, said annular belt having an uninterrupted outer surface.

15. The pump of claim 14 wherein said second annulus is defined by said annular belt and the first end portion of said cylindrical sleeve.

16. The pump of claim 10 further comprising a fuel fill tube extending from said pump body, said pump adapted to be received by an engine block and secured to the engine block by at least one bolt extending through said pump body and into the engine block, and said fuel fill tube adapted to be received by a socket located in the engine block for angularly aligning said pump with respect to the engine block.

17. The pump of claim 10 wherein the interfitting of the first end portion of said cylindrical sleeve with said pump body end portion is a press-fit.

18. The pump of claim 17 wherein the press-fit sufficiently induces compressive forces in said pump body for acting on said pumping chamber to oppose pumping chamber expansive forces.

19. The pump of claim 10 further comprising a retainer guide, wherein said cylindrical sleeve has an aperture, and wherein the housing of said cam follower assembly has an elongated slot in communication with the aperture, and the retainer guide extends through the aperture and engages the slot thereby allowing said cam follower assembly to relatively reciprocate within said cylindrical sleeve while said retainer guide is engaging the slot.

20. The pump of claim 10 further comprising a plunger spring seat received in the housing of said cam follower assembly wherein a first end of said plunger spring abuts said plunger spring seat and a second end of said plunger spring abuts said pump body end portion, said plunger spring seat having an entry hole in communication with a pivot hole, the pivot hole defining a seat pivot surface, the tail end of said plunger being receivable through the entry hole for engagement with the pivot hole, and the tail end of said plunger having a plunger pivot surface pivotally engaging the seat pivot surface when the tail end of said plunger is engaged with the pivot hole.

21. The pump of claim 20 wherein the seat pivot surface and the plunger pivot surface are spherical.

22. The pump of claim 21 wherein the seat pivot surface and plunger pivot surface are matching spherical surfaces of equal radii.

23. A pump for a fuel injection system, the pump comprising:

a pump body having a pumping chamber, a fuel inlet for supplying fuel to said pumping chamber, an outlet port, and a control valve chamber between said pumping chamber and said outlet port, a first annulus in communication with said fuel inlet for supplying fuel to said fuel inlet, a second annulus in communication with said pumping chamber and said control valve chamber for receiving excess fuel therefrom, and an annular belt separating said first and second annuli, said annular belt having an uninterrupted outer surface;

a reciprocating plunger disposed in said pumping chamber, said plunger having a head end and a tail end, said plunger being reciprocatable over a stroke range between an extended position and a retracted position;

a plunger spring for resiliently biasing said plunger to the retracted position; and a control valve disposed in said control valve chamber for controlling fuel.

24. The pump of claim 23 further comprising a fuel fill tube extending from said pump body, said pump adapted to be received by an engine block and secured to the engine block by at least one bolt extending through said pump body and into the engine block, and said fuel fill tube adapted to be received by a socket located in the engine block for angularly aligning said pump with respect to the engine block.

25. A pump for a fuel injection system, the pump comprising:

a pump body having a pumping chamber, a fuel inlet for supplying fuel to said pumping chamber, an outlet port, and a control valve chamber between said pumping chamber and said outlet port, a first annulus in communication with said fuel inlet for supplying fuel to said fuel inlet, a second annulus in communication with said pumping chamber and said control valve chamber for receiving excess fuel therefrom, and an annular belt separating said first and second annuli, said annular belt having an uninterrupted outer surface;

a reciprocating plunger disposed in said pumping chamber, said plunger having a head end and a tail end, said plunger being reciprocatable over a stroke range between an extended position and a retracted position;

a plunger spring for resiliently biasing said plunger to the retracted position;

a control valve disposed in said control valve chamber for controlling fuel;

a stator assembly;

an electromagnetic actuator disposed in said stator assembly;

an armature secured to said control valve, said control valve being an electromagnetically actuated control valve and including a piston valve body axially movable between an unactuated position and an actuated position within said control valve chamber;

a valve stop disposed in said pump body adjacent said control valve chamber;

a stop plate securing said valve stop within said pump body;

a control valve spring for resiliently biasing said piston valve body into the unactuated position;

a stator spacer disposed between said pump body and said stator assembly and having a central opening for receiving said armature therein; and a plurality of fasteners mounting said stator assembly on said pump body, each fastener extending through said stator assembly, said stator spacer, and said pump body, for securing said stop plate against said valve stop whereby upon actuation of said control valve, said piston valve body is urged to the actuated position against the biasing of said control valve spring.

26. The pump of claim 25 wherein said stop plate is elastically deformable and said valve stop extends outboard of said pump body, and wherein said stop plate is elastically deformed when securing said valve stop.

27. The pump of claim 25 further comprising a fuel fill tube extending from said pump body, said pump adapted to be received by an engine block and secured to the engine block by at least one bolt extending through said pump body and into the engine block, and said fuel fill tube adapted to be received by a socket located in the engine block for angularly aligning said pump with respect to the engine block.

28. The pump of claim 25 wherein an annular fuel filter is disposed in said pump body about a central axis of said piston valve body.

29. In combination with an engine block, a pump for a fuel injection system, the pump comprising:

a pump body having a pumping chamber, a fuel inlet for supplying fuel to said pumping chamber, an outlet port, and a control valve chamber between said pumping chamber and said outlet port;

a reciprocating plunger disposed in said pumping chamber, said plunger having a head end and a tail end, said plunger being reciprocatable over a stroke range between an extended position and a retracted position;

a plunger spring for resiliently biasing said plunger to the retracted position;

a control valve disposed in said control valve chamber for controlling fuel; and a fuel fill tube extending from said pump body, said pump being secured to the engine block, and said fuel fill tube being received by a socket located in the engine block to angularly align said pump with respect to the engine block.

30. In combination with an engine block, a pump for a fuel injection system, the pump comprising:

a pump body having a pumping chamber, a fuel inlet for supplying fuel to said pumping chamber, an outlet port, and a control valve chamber between said pumping chamber and said outlet port;

a reciprocating plunger disposed in said pumping chamber, said plunger having a head end and a tail end, said plunger being reciprocatable over a stroke range between an extended position and a retracted position;

a plunger spring for resiliently biasing said plunger to the retracted position;

a control valve disposed in said control valve chamber for controlling fuel;

a fuel fill tube extending from said pump body, said pump being secured to the engine block, and said fuel fill tube being received by a socket located in the engine block to angularly align said pump with respect to the engine block;

a stator assembly;

an electromagnetic actuator disposed in said stator assembly;

an armature secured to said control valve, said control valve being an electromagnetically actuated control valve and including a piston valve body axially movable between an unactuated position and an actuated position within said control valve chamber;

a valve stop disposed in said pump body adjacent said control valve chamber;

a stop plate securing said valve stop within said pump body;

a control valve spring for resiliently biasing said piston valve body into the unactuated position;

a stator spacer disposed between said pump body and said stator assembly and having a central opening for receiving said armature therein; and a plurality of fasteners mounting said stator assembly on said pump body, each fastener extending through said stator assembly, said stator spacer, and said pump body, for securing said stop plate against said valve stop whereby upon actuation of said control valve, said piston valve body is urged to the actuated position against the biasing of said control valve spring.

31. The combination of claim 30 wherein said stop plate is elastically deformable and said valve stop extends outboard of said pump body, and wherein said stop plate is elastically deformed when securing said valve stop.

32. A pump for a fuel injection system, the pump comprising:

a pump body having a pumping chamber, a fuel inlet for supplying fuel to said pumping chamber, an output port, and a control valve chamber between said pumping chamber and said outlet port;

a reciprocating plunger disposed in said pumping chamber, said plunger having a head end and a tail end, said plunger being reciprocatable over a stroke range between an extended position and a retracted position;

a plunger spring for resiliently biasing said plunger to the retracted position;

a stator assembly;

an electromagnetic actuator disposed in said stator assembly;

an electromagnetically actuated control valve disposed in said control valve chamber for controlling fuel, said control valve including a piston valve body axially movable between an unactuated position and an actuated position within said control valve chamber;

an armature secured to said control valve;

a valve stop disposed in said pump body adjacent said control valve chamber and extending outboard of said pump body;

an elastically deformable stop plate securing said valve stop within said pump body;

a control valve spring for resiliently biasing said piston valve body into the unactuated position;

a stator spacer disposed between said pump body and said stator assembly and having a central opening for receiving said armature therein; and a plurality of fasteners mounting said stator assembly on said pump body, each fastener extending through said stator assembly, said stator spacer, and said pump body, for securing said stop plate against said valve stop, said stop plate being elastically deformed when secured against said valve stop, whereby upon actuation of said control valve, said piston valve body is urged to the actuated position against the biasing of said control valve spring.

33. A pump for a fuel injection system, the pump comprising:

a pump body having a pump body end portion, a pumping chamber, a fuel inlet for supplying fuel to said pumping chamber, an outlet port, and a control valve chamber between said pumping chamber and said outlet port;

a reciprocating plunger disposed in said pumping chamber, said plunger having a head end and a tail end, said plunger being reciprocatable over a stroke range between an extended position and a retracted position;

a plunger spring for resiliently biasing said plunger to the retracted position;

a stator assembly;

an electromagnetic actuator disposed in said stator assembly;

an electromagnetically actuated control valve disposed in said control valve chamber for controlling fuel, said control valve including a piston valve body axially movable between an unactuated position and an actuated position within said control valve chamber;

an armature secured to said control valve;

a valve stop disposed in said pump body adjacent said control valve chamber;

an elastically deformable stop plate securing said valve stop within said pump body;

a control valve spring for resiliently biasing said piston valve body into the unactuated position;

a stator spacer disposed between said pump body and said stator assembly and having a central opening for receiving said armature therein;

a plurality of fasteners mounting said stator assembly on said pump body, each fastener extending through said stator assembly, said stator spacer, and said pump body, for securing said stop plate against said valve stop whereby upon actuation of said control valve, said piston valve body is urged to the actuated position against the biasing of said control valve spring;

a cam follower assembly including a housing receiving the tail end of said plunger therein, said cam follower assembly having an elongated slot;

a cylindrical sleeve having an aperture in communication with the elongated slot, said cylindrical sleeve further having first and second end portions, said pump body end portion being press-fit into the first end portion of said cylindrical sleeve, said press-fit sufficiently inducing compressive forces in said pump body for acting on said pumping chamber to oppose pumping chamber expansive forces, and the second end portion relatively reciprocatably interfitting with said cam follower assembly for allowing said cam follower assembly to drive said plunger thereby reciprocating said plunger with respect to said cylindrical sleeve over the stroke range;

a retainer guide extending through the aperture in the cylindrical sleeve and engaging the slot in the cam follower assembly thereby allowing said cam follower assembly to relatively reciprocate within said cylindrical sleeve while said retainer guide is engaging the slot; and a plunger spring seat received in the housing of said cam follower assembly wherein a first end of said plunger spring abuts said plunger spring seat and a second end of said plunger spring abuts said pump body end portion, said plunger spring seat having an entry hole in communication with a pivot hole, the pivot hole defining a seat pivot surface, the tail end of said plunger being receivable through the entry hole for engagement with the pivot hole, and the tail end of said plunger having a plunger pivot surface pivotally engaging the seat pivot surface when the tail end of said plunger is engaged with the pivot hole.

34. A pump for a fuel injection system, the pump comprising:

a pump body having a pump body end portion, a pumping chamber, a fuel inlet for supplying fuel to said pumping chamber, a first annulus in communication with said fuel inlet for supplying fuel to said fuel inlet, a second annulus in communication with said pumping chamber for receiving excess fuel therefrom, and an annular belt separating said first and second annuli, said annular belt having an uninterrupted outer surface, said pump body further having an outlet port, and a control valve chamber between said pumping chamber and said outlet port;

a fuel fill tube extending from said pump body, said pump adapted to be received by an engine block and secured to the engine block by at least one bolt extending through said pump body and into the engine block, and said fuel fill tube adapted to be received by a socket located in the engine block for angularly aligning said pump with respect to the engine block;

a reciprocating plunger disposed in said pumping chamber, said plunger having a head end and a tail end, said plunger being reciprocatable over a stroke range between an extended position and a retracted position;

a plunger spring for resiliently biasing said plunger to the retracted position;

a stator assembly;

an electromagnetic actuator disposed in said stator assembly;

an electromagnetically actuated control valve disposed in said control valve chamber for controlling fuel, said control valve including a piston valve body axially movable between an unactuated position and an actuated position within said control valve chamber;

an annular fuel filter disposed in said pump body about a central axis of said piston valve body;

an armature secured to said control valve;

a valve stop disposed in said pump body adjacent said control valve chamber and extending outboard of said pump body;

an elastically deformable stop plate securing said valve stop within said pump body;

a control valve spring for resiliently biasing said piston valve body into the unactuated position;

a control valve spring seat disposed in said pump body and abutting a first end of said control valve spring;

a control valve spring retainer disposed between said control valve spring and said armature, and abutting a second end of said control valve spring;

a stator spacer disposed between said pump body and said stator assembly and having a central opening for receiving said armature therein;

a plurality of fasteners mounting said stator assembly on said pump body, each fastener extending through said stator assembly, said stator spacer, and said pump body, for securing said stop plate against said valve stop, said stop plate being elastically deformed when secured against said valve stop, whereby upon actuation of said control valve, said piston valve body is urged to the actuated position against the biasing of said control valve spring;

a cam follower assembly including a housing receiving the tail end of said plunger therein, said cam follower assembly having an elongated slot;

a cylindrical sleeve having an aperture in communication with the elongated slot, said cylindrical sleeve further having first and second end portions, said pump body end portion being press-fit into the first end portion of said cylindrical sleeve, said press-fit sufficiently inducing compressive forces in said pump body for acting on said pumping chamber to oppose pumping chamber expansive forces, and the second end portion relatively reciprocatably interfitting with said cam follower assembly for allowing said cam follower assembly to drive said plunger thereby reciprocating said plunger with respect to said cylindrical sleeve over the stroke range;

a retainer guide extending through the aperture in the cylindrical sleeve and engaging the slot in the cam follower assembly thereby allowing said cam follower assembly to relatively reciprocate within said cylindrical sleeve while said retainer guide is engaging the slot; and a plunger spring seat received in the housing of said cam follower assembly wherein a first end of said plunger spring abuts said plunger spring seat and a second end of said plunger spring abuts said pump body end portion, said plunger spring seat having an entry hole in communication with a pivot hole, the pivot hole defining a seat pivot surface, the tail end of said plunger being receivable through the entry hole for engagement with the pivot hole, and the tail end of said plunger having a plunger pivot surface pivotally engaging the seat pivot surface when the tail end of said plunger is engaged with the pivot hole.

35. The pump of claim 34 wherein said second annulus is defined by said annular belt and the first end portion of said cylindrical sleeve.

* * * * *

UNITED STATES PATENT AND TRADEMARK OFFICE

CERTIFICATE OF CORRECTION

PATENT NO : 5,749,717

DATED : May 12, 1998

INVENTOR(S) : Robert D. Straub et al.

It is certified that error appears in the above-identified patent and that said Letters Patent is hereby corrected as shown below:

In the Title, delete "ELECTROMAGNETIC FUEL PUMP FOR A COMMON RAIL FUEL INJECTION SYSTEM" and insert --ELECTROMAGNETIC UNIT PUMP FOR A DIESEL FUEL INJECTION SYSTEM--.

Claim 1, Line 17 of Claim 1, immediately before "cylindrical" insert --a--.

Signed and Sealed this

Eighth Day of September, 1998

*Attest:*

Bruce Lehman

BRUCE LEHMAN

*Attesting Officer*

*Commissioner of Patents and Trademarks*